US006152701A

United States Patent [19]

Gurfinkel Castillo et al.

[11] Patent Number: 6,152,701

[45] Date of Patent: Nov. 28, 2000

[54] METHOD FOR DESIGNING A PIPELINE SYSTEM FOR TRANSPORTING A FLUID SUBJECT TO DETERIORATION AT ELEVATED PRESSURE AND ELEVATED TEMPERATURE

[75] Inventors: Mariano Eurique Gurfinkel Castillo; Gustavo A Núñez; Geoff McGrath, all of Caracas, Venezuela

[73] Assignee: Intevep, S.A., Caracas, Venezuela

[21] Appl. No.: 09/028,783

[22] Filed: Feb. 24, 1998

[51] Int. Cl.[7] ..... F04B 19/24; F04C 2/00

[52] U.S. Cl. ..... 417/53; 418/150

[58] Field of Search ..... 417/53; 418/1, 418/150, 216, 220

[56] References Cited

U.S. PATENT DOCUMENTS

| | | | |
|---|---|---|---|
| 4,343,755 | 8/1982 | Miller et al. | 264/176 R |
| 4,344,752 | 8/1982 | Gallagher, Jr. | 431/354 |
| 5,357,784 | 10/1994 | Collier | 73/54.14 |
| 5,381,886 | 1/1995 | Hay | 198/642 |

OTHER PUBLICATIONS

Selecting the right impeller for a given mixing application by Tom Post, Ph.D., www.chemicalprocessing.com/protected/fluiidflow/51.shtml, 1997.

Newtonian vs. non–Newtonian fluids, by J. Chaurette,www.cam.org/~jacobie/faqonp~1.htm, 1997.

*Primary Examiner*—Henry C. Yuen
*Assistant Examiner*—Mahmoud M Gimie
*Attorney, Agent, or Firm*—Bachman & LaPointe, P.C.

[57] ABSTRACT

The present invention relates to a method for designing handling systems such as pipeline systems for fluid products such as emulsions and dispersions which deteriorate at elevated temperature and pressure. The method of the present invention comprises the steps of providing a pipeline having a fluid inlet point and a fluid discharge point and at least one pump for transporting the fluid from the fluid inlet point to the fluid discharge point, selecting one of a maximum pressure drop to be encountered by the fluid as it travels from the fluid inlet point to the fluid discharge point and a maximum volume of fluid to be handled by the system, and operating the system in accordance with the following equation:

$$\frac{Q}{D^3} < B$$

where B is the maximum allowable shear rate from a first fluid inlet point to a second fluid discharge point, D is the diameter of the pipeline, and Q is the volume of fluid to be transported between the fluid inlet point and the fluid discharge point.

10 Claims, 1 Drawing Sheet

METHOD FOR DESIGNING A PIPELINE SYSTEM FOR TRANSPORTING A FLUID SUBJECT TO DETERIORATION AT ELEVATED PRESSURE AND ELEVATED TEMPERATURE

BACKGROUND OF THE INVENTION

The present invention relates to a method for designing a pipeline system for transporting a fluid subject to deterioration at elevated pressure and elevated temperature. The method of the present invention has particular utility in designing a pipeline system for transporting emulsions and dispersions.

Fluid products, such as emulsions and dispersions, are often transported, via pipeline systems, from a production station to a storage facility or a transportation station. Some pipeline systems are sufficiently short that they only require a pump farm. In such systems, the discharge pressure of the pumps typically reach 400 to 500 psi. It is possible however for the discharge pressures of the pumps to exceed 600 psi. Due to limitations in storage capacity and production capabilities, temperatures in a pipeline may exceed 120° F. Certain fluid products, such as emulsions and dispersions, travelling through such pipelines often deteriorate as a result of the elevated shear at elevated temperatures which are encountered. This deterioration may take the form of a degradation in geometrical properties such as droplet diameter distribution or a degradation in the stability (static or dynamic) of the fluid products.

In order to limit the deterioration of fluid products as they travel through such systems, it is necessary to address certain operational aspects of the pipeline systems. The present invention addresses the problem associated with deterioration caused by elevated shear rates and pressures and leads to the design of improved pipeline systems for transporting such fluid products.

SUMMARY OF THE INVENTION

Accordingly, it is a principal object of the present invention to provide a method for designing a pipeline system for transporting a fluid subject to deterioration at elevated pressure and elevated temperature.

It is a further object of the present invention to provide a method as above which has particular utility for designing pipeline systems that transport emulsions and dispersions.

The foregoing objects are attained by the method of the present invention which broadly comprises the steps of: providing a pipeline having a fluid inlet point and a fluid discharge point and at least one pump for transporting the fluid from the fluid inlet point to the fluid discharge point; selecting one of a maximum pressure drop to be encountered by the fluid as it travels from the fluid inlet point to the fluid discharge point and a maximum volume of fluid to be handled by the system; and operating the system in accordance with the following equation:

$$\frac{Q}{D^3} < B$$

where B is the maximum allowable shear rate from a first fluid inlet point to a second fluid discharge point, D is the diameter of the pipeline, and Q is the volume of fluid to be transported between the fluid inlet point and the fluid discharge point. The method of the present invention also takes into account the need for cooling the fluid travelling through the pipeline system and the characteristics of the pump or pumps used in the pipeline system.

Other details of the method of the present invention, as well as other objects and advantages attendant thereto, will become apparent from the following detailed description and the accompanying drawings wherein like reference numerals depict like elements.

DETAILED DESCRIPTION OF THE PREFERRED EMBODIMENT(S)

Figure 1:
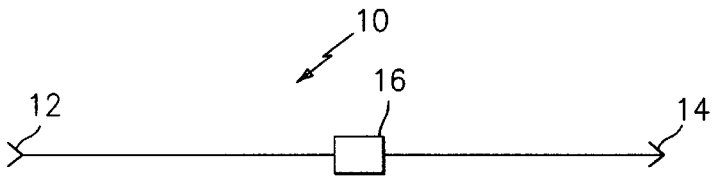
FIG. 1 is a schematic representation of a portion of a pipeline system for transporting fluid products.

A pipeline system generally includes a pipeline extending between a number of stations. For example, a pipeline system may have a first section which extends from a production facility to a storage facility. It may also have a section which extends from a storage facility to a loading facility. Some systems may have a single length of pipeline which extends between the production facility and the loading facility. Typically, each section includes a pumping facility which includes one or more pumps such as screw pumps. FIG. 1 illustrates one such section of pipeline. As shown therein, the system includes a fluid inlet point 12, a fluid discharge point 14 and at least one pump 16 for transporting the fluid from the inlet point 12 to the discharge point 14. The pump 16 may be, for example, a screw pump or centrifugal pump.

It has been found that in order to limit deterioration of a fluid product, such as an emulsion or a dispersion, as it passes through a pipeline system 10 from a first inlet point 12 to a second point 14 requires the implementation of certain operational solutions. By implementing these solutions, it becomes possible to transport the fluid so that it arrives at the discharge point within desired product specifications, i.e stability, droplet diameter distribution, etc.

One way of handling the deterioration problem is to fix an upper limit to the discharge pressure observed in the pump (s) 16 while keeping constant inlet pressure in this example. However, discharge pressure is a function of the total volume of fluid handled by the pumps, in the case of several pumps in parallel, and of the apparent product viscosity within the pipeline. By fixing a maximum limit to the discharge pressure, the volume that can be handled by the transfer system becomes limited.

One can better design a pipeline system for fluids such as temperature, and for pressure and/or shear sensitive emulsions and dispersions by recognizing that the maximum volume to be handled by the pipeline is a linear function of the maximum permitted discharge pressure and an inverse function of the apparent viscosity of the fluid product. It should also be recognized that the maximum volume which can be handled is also a function of the pipeline geometric properties, such as the length and diameter of the pipeline, the accessories (for example valves, etc.) employed in the pipeline, and the profile of same. Since all of these factors are fixed, their effect can be included within a constant a which can be determined from the flow conditions within the system. In general, it has been found that a section of a pipeline from a first point 12 to a second point 14 operating in accordance with the following equation has reduced product deterioration due to elevated temperature and pressure:

$$\frac{Q}{D^3} < B \tag{1}$$

where B is the maximum allowable shear rate from a first fluid inlet point to a second fluid discharge point, D is the diameter of the pipeline, and Q is the volume of fluid to be transported between the fluid inlet point and the fluid discharge point. It has been found that operating in accordance with this equation provides a certain reliability.

In certain situations, it may be desirable for one reason or another, to control the temperature of the product being pumped. This may be accomplished by installing heat exchangers upstream of the pump(s) to reduce the temperature of the product being pumped.

In other situations, there may be a need to increase the rate at which the fluid product is being pumped through the pipeline. In such instances, one must look to the effect of other elements or structures within the pipeline. For example, one must look to the effect of pumps, such as two-screw pumps, at high pressure on the behavior of the fluid product being transported.

As previously noted, the amount of product deterioration (as measured by an increase in the percentage of the large diameter droplets) is an increasing function of the discharge pressure of the pumps (more specifically, a function of the pressure differential of the pumps). In screw pumps, the volumetric efficiency is a decreasing function of the pressure differential supplied by the pump. This is because the screw pumps are characterized by spaces between the screws and the housing and spaces between the screws within which the fluid can recirculate or re-enter. This recirculation flow is called "slip" or "slip flow" and is a function of the geometric characteristics of the pumps, the operating conditions and the fluid properties.

Figure 2:
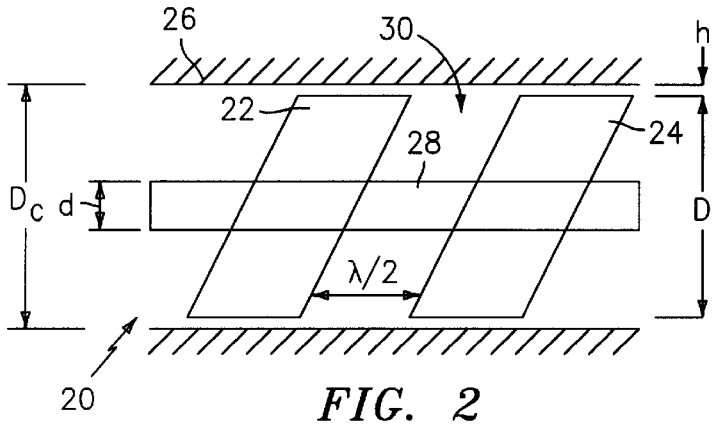
FIG. 2 is a schematic representation of a one-screw pump.

The flow within a two-screw pump can be visualized as the flow within a one-screw pump with similar characteristics. Referring now to FIG. 2, the simplified pump 20 has a single screw 21 with pitches 22 and 24. The screw has an external diameter D. The screw is located within a housing 26 having a diameter of $D_c$ where $D_c$=D+2h and where h is the distance between the screw and the housing. The distance h is commonly called the "gap". As shown in FIG. 2, the pitches 22 and 24 are centered within the housing.

In general, the diameter d of the screw pump shaft 28 is usually less than the external diameter D of the screw 21, resulting in a cavity 30 between the two screw pitches 22 and 24. The volume $V_c$ of the cavity 30 is a function of the screw pitch, the diameters previously mentioned, and the geometry of the screws. In the simplest case, the cavity volume, equivalent to the volume displaced by the pump, because of the shaft rotation, is equal to:

$$V_c = \pi(D_c^2 - d^2)\frac{\lambda}{2}. \tag{2}$$

where λ=screw pitch. The theorical volume, $Q_t$, handled by a screw pump is a function of the cavity volume and the rotation velocity ω of the pump shaft and may be expressed as:

$$Q_t = \omega V_c = \omega\pi(D_c^2 - d^2)\frac{\lambda}{2}. \tag{3}$$

The real volume $Q_r$ handled by a screw pump is less than the theorical volume since the fluid can and, in fact, does reenter through the space h between the screw 21 and the housing 26. The amount of fluid which reenters is a function of the geometry of the screw pump, the fluid properties, and the pump operating conditions. The difference between the theorical volume and real volume is called slip volume $Q_s$. In other words, $$Q_s = Q_t - Q_r. \tag{4}$$

The volumetric efficiency $\eta_{vol}$, is defined as the coefficient between the real and the theorical volume:

$$\eta_{vol} = \frac{Q_r}{Q_t} = 1 - \frac{Q_s}{Q_t}. \tag{5}$$

The reason why the slip is of great interest is because the volume is subjected to confirmed damage mechanism. The spaces within the screw pump 20 where the slip flow passes through are small. For this reason, damage to the product passing through these spaces can be expected. The damage which occurs is believed to be very close to the total damage of the slip flow. It has to be pointed out however that the slip flow is a real flow percentage handled by the pump.

As previously indicated, the slip flow is determined by several factors. For this reason, the slip flow shall be estimated, based on a successive of approximations. In order to perform said approximations, it shall be taken into account that:

$$\frac{h}{D} \ll 1, \tag{6}$$

$$\frac{h}{\lambda} \ll 1. \tag{7}$$

The inequality (6) allows one to consider the flow between two infinite parallel plates (only a depth equal to πD is considered) instead of considering the annular geometry. On the other hand, the inequality (7) permits one to depreciate the entrance or edge effects, which allows one to consider a flow locally in evolution in the axial sense of the pump.

With respect to the fluid properties, as zeroeth order approximation, the fluid will be considered as Newtonian, characterized by an effect dynamic viscosity, $\mu_{pump}$. In fact, the product should not be described as a Newtonian fluid, since the viscosity is a function of the flow pattern, the flow history, etc. which would make the estimates virtually impossible. This approximation shall be considered again farther on.

Since the flow is considered to be Newtonian and highly viscous, the inertial effects can be depreciated. This type of flow is commonly called Stokes flow. The flow is described by the following equation:

$$-\Delta p + \Delta^2\mu = 0 \tag{8}$$

As it can be observed, the equation is linear, which allows the superposition of known solutions for obtaining new solutions.

Figure 3A:
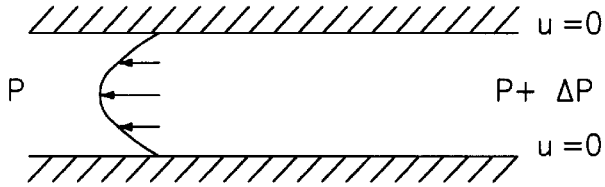
FIGS. 3(*a*)–3(*c*) illustrates the superimposition of flows between two parallel plates.
Figure 3B:
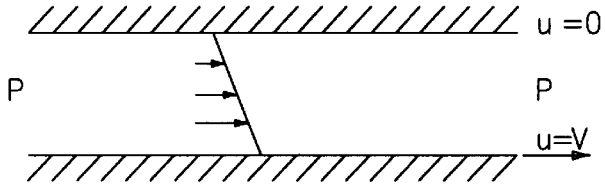
Figure 3C:
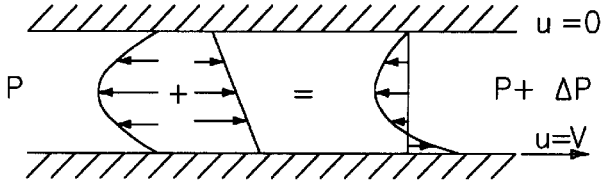

In the present case, the equivalent geometry after the simplifications, is given by two parallel plates separated by a small distance where the fluid is submitted to a pressure differential and to the dragging of the inferior plate, as shown in FIGS. 3*a*–3*c*. The total flow which is indicated in FIG. 3*c* is the result of the superposition of the flows indicated in FIG. 3*a* and FIG. 3*b*. The flow indicated in FIG. 3*a* is commonly called Poiseuille flow. In this flow, the inferior plate does not move. The flow is a consequence of the pressure difference between the two extremes of the plates (ΔP) and consequently, is from right to left (in countervolume within the cavities). On the contrary, the flow indicated in FIG. 3*b* is a consequence of the dragging of the inferior plate, since in this case there is no pressure difference. This flow goes in the same direction as the flow of the cavities and is known as Couette flow.

The flow, per depth unit, due to pressure differential is given by:

$$Q = \frac{1}{12\,\mu_{bomba}}\frac{dP}{dz}h^3 \tag{9}$$

where dP/dz is the pressure gradient in the flow drift of the cavities (therefore, it is positive). The equivalent depth of the annulus is equal to πD and the pressure gradient can be estimated as dP/dz=2ΔP/L where L is the total length of the screw. Substituting, the volume due to pressure differential $$Q_{Poiseuille} = \frac{\pi D}{6\,\mu_{bomba}}\frac{\Delta P}{L}h^3. \tag{10}$$

On the other side, the volume due to the inferior plate movement is given by:

$$Q_{Couette} = \frac{\pi D}{2}Vh = \frac{\pi D^2}{4}\omega h. \tag{11}$$

This volume is not function of the fluid properties but of the rotation velocity and of the geometrical characteristics of the screws.

By summing up the two volumes, the slip volume can be estimated as follows:

$$Q_s = Q_{Poiseuille} - Q_{Couette} \approx \beta_1\frac{1}{\mu_{bomba}}\Delta P\frac{Dh^3}{\lambda} - \beta_2 D^2 h\omega. \tag{12}$$

In Equation (12), two constants, $\beta_1$ and $\beta_2$ are included in order to group the constants. The variables have been grouped according to their origin: the product being pumped, the volume and the properties of the fluid (▽P) within the pipeline, and the geometrical characteristics (D, h,λ) of the screw-pump.

It should be noted that the hypothesis is based on saying that the deterioration of the product is proportional to the amount of the product passing through the regions of the slip. Therefore, the product deterioration (PD), relative to the volume handled by the pump is:

$$PD = f\left(\frac{Q_s}{Q_r}\right) \cong f\left(\frac{Q_s}{Q_t}\right) \cong \frac{\beta_1\frac{1}{\mu_{bomba}}\Delta P\frac{Dh^3}{\lambda} - \beta_2 D^2 h\omega}{\omega\pi(D_c^2 - d^2)\frac{\lambda}{2}}. \tag{13}$$

Equation (13) is the basis for the prediction of the product deterioration in the screw-pumps. It has to be noted that to reach this expression, various approximations had to be made, among which the assumption of the linearity of the fluid properties and the resulting consequences upon the equations. The effects of some of the most important variables will be described hereinbelow.

The space between the screw 10 and the housing h appears twice in equation (13). Before proceeding to the analysis of the effect h, it is worth observing that there exists experimental evidence that for flows between two parallel plates, when the equivalent separation is reduced, the deterioration increases. As it is indicated in Equation (13), the product damage in the screw-pumps can be represented by:

$$PD = \Phi_1 h^3 - \Phi_2 h \tag{14}$$

where $\Phi_1$ and $\Phi_2$ are positive constants. For big values of h, ($h > (\Phi_2/\Phi_1)^{1/2}$), by increasing h, the product damage PD also increases. It has to be noted that this is valid for the sufficiently small values of h for which the product deterioration PD is complete. Thus, one way to reduce product deterioration is by reducing the gap between each screw and the housing. For extremely high values of h, the effectivity of the product damage mechanisms is reduced, therefore Equation (13) is not applicable anymore.

The values for which some increases of h result in a reduction of the damage are not practical since they are extremely small.

It can be expected that the product deterioration increases with an increment of ω, since all the known damage mechanisms are intensified with ω. In this case, ω appears in the denominator, as indicated hereinbelow:

$$PD \cong \frac{\Phi_3}{\omega} - \Phi_4. \tag{15}$$

It can be observed that with an increment of ω, the global damage to the product diminishes. This can be interpretated within the framework of the volumetric efficiency increase with ω. Thus, another way to reduce the percent of product damage is by increasing the rotation velocity of the pump shaft.

The product rheology has an interesting effect on the product deterioration. One could think, incorrectly, that an increase of the product effective viscosity would result in a reduction of the product deterioration, since it appears in the denominator of the following expression:

$$PD \cong \Phi_5\frac{\Delta P}{\nu_{bomba}} - \Phi_4. \tag{16}$$

It has to be noted however that in a real system, the pump is coupled to a pipeline. Therefore, the pressure drop within same, ▽P, is a function of the apparent viscosity of the product $\nu_{oil}$.

$$D \cong \Phi_5\frac{\Delta P(\nu_{oleo})}{\nu_{bomba}} - \Phi_4. \tag{17}$$

This implies that the relation between the two viscosities: $\nu_{oil}/\nu_{pump}$ is important. In the case of an emulsion product known as Orimulsion®, while the product inversion does not exist, $\nu_{oil}/\nu_{pump} > 1$ since the emulsion is similar to a fluid whose viscosity diminishes with the cut rate. Since there exists an inversion in the gap, the effective viscosity cannot be predicted in this region. Thus, the viscosity of the product must not be used as a variable to reduce the product deterioration.

On the other hand, lowering the temperature of the product, when pumped, reduces the effective viscosity within the gap, $\nu_{pump}$, but not the effective viscosity within the pipeline, since it has the same temperature as room temperature. By reducing $\nu_{pump}$ with a decrease of the product temperature, the slip flow decreases and hence, reduces deterioration of the product.

The effect of the suction pressure on the product deterioration cannot be estimated for sufficiently high values of same. When the values of the pressure are sufficiently low, evaporation of the continuous phase may happen and consequently, the product suffers a massive damage. For this to happen in static conditions, the pressure is very close to absolute zero (water vapor pressure). In dynamic conditions, the pressure in the suction head does not have to reach such low values, and depends on the geometry of the pump. Once again, the zone of the damage dynamic mechanisms, related in this case with the suction pressure, is the same as the slip region. Therefore, the low suction pressures only amplifies ("modulates") the expected damage under normal conditions.

A conclusion that can be drawn from the foregoing is that the operational variable of a two-screw pump which has to be used for its selection is the volumetric efficiency of same. The better the efficiency, the less the product deterioration will be. In order to increase the volumetric efficiency of a pump, the rotation velocity of same can be increased. As a result, the product deterioration diminishes. At a design level, both the gap and the screw pitch can be used. If the gap h is reduced, the slip flow is also reduced drastically. The reduction of the gap however is limited by mechanical restrictions since the heat generation increases and the effect of the fluid lubrication between the screw and the housing is diminished. On the other side, the screw pitch, $\lambda$, can be increased in order to reduce the product deterioration.

It is apparent that there has been provided in accordance with the present invention a method for designing a pipeline for emulsions and dispersions which fully satisfies the objects, means and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

What is claimed is:

1. Method for designing a pipeline system for transporting a fluid subject to deterioration at elevated pressure and elevated temperature comprising the steps of:

providing a pipeline having a fluid inlet point and a fluid discharge point and at least one pump for transporting said fluid from said fluid inlet point to said fluid discharge point;

selecting one of a maximum pressure drop to be encountered by said fluid as it travels from said fluid inlet point to said fluid discharge point and a maximum volume of fluid to be handled by said system; and operating said system in accordance with the following equation:

$$\frac{Q}{D^3} < B$$

where B=the maximum allowable shear rate from a first fluid inlet point to a second fluid discharge point;

D=the diameter of the pipeline; and

Q=the volume of fluid to be transported between the fluid inlet point and the fluid discharge point.

2. The method of claim 1 further comprising:

cooling said fluid prior to storage so as to reduce product temperature when being pumped.

3. The method of claim 2 wherein said cooling step comprises passing said fluid through a heat exchanger.

4. The method of claim 1 wherein said fluid is an emulsion.

5. The method of claim 1 wherein said fluid is a dispersion.

6. The method of claim 1 further comprising:

determining the product deterioration caused by said at least one pump.

7. The method of claim 1 further comprising:

determining the product deterioration caused by said at least one pump using the equation:

$$PD = \frac{\beta_1 \frac{1}{\mu} \Delta P \frac{Dh^3}{\lambda} - \beta_2 D^2 h\omega}{\omega\pi(D_c^2 - d^2)\frac{\lambda}{2}}$$

where PD=product deterioration $\beta_1$=constant $\beta_2$=constant h=space between pump screw and pump housing $\omega$=rotation velocity of screw $\Delta P$=pressure drop across pump $\mu$=viscosity of the fluid $\lambda$=screw pitch $D_c$=diameter of housing D=external diameter of screw d=diameter of screw pump shaft.

8. The method of claim 1 further comprising:

wherein the said at least one pump is a screw pump having a plurality of screws and the method comprises the further step of reducing product deterioration by increasing rotation velocity of each screw in said at least one pump.

9. The method of claim 1 further comprising:

reducing product deterioration by increasing the pitch of each screw in said at least one pump.

10. The method of claim 1 further comprising:

reducing product deterioration by reducing the gap between each screw and the housing in said at least one pump.

* * * * *